United States Patent [19]

Mizutani

[11] 4,217,744

[45] Aug. 19, 1980

[54] PACKAGING MACHINE

[75] Inventor: Shigemitsu Mizutani, Nakanuma Ashigara, Japan

[73] Assignee Fuji Photo Film Co., Ltd., Minami-Ashigara, Japan

[21] Appl. No.: 14,788

[22] Filed: Feb. 26, 1979

[30] Foreign Application Priority Data

Feb. 24, 1978 [JP] Japan ..... 53-20580

[51] Int. Cl.[2] ..... B65B 57/04; B65B 57/12

[52] U.S. Cl. ..... 53/55; 53/66; 53/71; 53/74; 53/389

[58] Field of Search ..... 53/55, 64, 66, 71, 74, 53/228, 389

[56] References Cited

U.S. PATENT DOCUMENTS

| | | | |
|---|---|---|---|
| 3,982,375 | 9/1976 | Focke | 53/389 X |
| 4,135,344 | 1/1979 | Seragnoli | 53/64 X |

*Primary Examiner*—Travis S. McGehee

*Attorney, Agent, or Firm*—Sughrue, Rothwell, Mion, Zinn and Macpeak

[57] ABSTRACT

A packaging machine in which a belt-shaped packaging sheet fed continuously is cut to a predetermined length while being guided and conveyed in a direction intersecting the conveyance direction of articles to be packaged. Position detectors detect the arrival of the top end of said packaging sheet, detect the arrival of each article at a position before the position where said article crosses said packaging sheet and the arrival of the top end of the packaging sheet returned from the feeding limit position by being moved as said article abuts against said packaging sheet and is further conveyed, at a predetermined reverse return position. The detectors are used to generate the necessary control signals for feeding and cutting the packaging sheet.

9 Claims, 2 Drawing Figures

PACKAGING MACHINE

BACKGROUND OF THE INVENTION

This invention relates to an improvement in a packaging machine, and more particularly to a packaging machine in which a belt-shaped packaging sheet fed continuously by feeding means is cut to a predetermined length by cutting means while being guided and conveyed in a direction intersecting the conveyance direction of articles to be packaged. Also, the packaging sheet is folded in two to package each article as the article is conveyed.

The packing sheet in this invention has a base material such as paper, cellophane, plastic or the like. It is wound in the form of a roll. In the packaging operation, the packaging sheet in the form of a roll is unwound and cut to a predetermined length, to package an article.

Conventional packaging machines have a belt-shaped packaging sheet fed continuously by feeding means and the sheet is cut to a predetermined length by cutting means while being guided and conveyed in a direction intersecting the conveyance direction of articles to be packaged. The packaging sheet is folded in two to package each article as the article is conveyed. This system has disadvantages in the following aspects. As shown in FIG. 1, when the open sides of the packaging sheet which has been folded in two as described above are sealed by heat-welding, gluing or the like, the open edges e and e' of the two portions of the packaging sheet B which overlap one on another to package the article A are shifted from each other as indicated by d. This shift will impair considerably the packaging effect and the appearance of the package.

This shift difference d is due to the packaging sheet feeding mechanism in the conventional packaging machine. More specifically, in the packaging sheet feeding mechanism in the conventional packaging machine, in general, a feeding roll adapted to feed the packaging sheet wound in the form of a roll, and a cutter drum with a cutter for cutting the fed packaging sheet in the widthwise direction are provided as one unit, and the diameter of the cutter drum is set so that its circumference is equal to the whole length of the packaging sheet required for one package. Therefore, if the timing at which the article to be packaged is conveyed to the surface of the packaging sheet is only slightly varied or the packaging sheet feeding speed fluctuates, the variation results in the shift at a distance d as described above.

In general, a thin packaging sheet is expanded or contracted under environmental conditions such as temperature and humidity or by tension, depending upon its composition. Therefore, the length set on the cutter drum or the like is unavoidably somewhat different from the length of the packaging sheet actually cut. Thus, it is necessary to provide a technique adapted to correct the above-described shift d for the device which feeds and cuts the packaging sheet having such elasticity. However, since the diameter of the cutter drum is preset in the packaging sheet feeding mechanism of the conventional packaging machine, different cutter drums or feeding rolls must be used for packaging articles different in size. That is, the cutter drum or the feeding roll must be exchanged for another one whenever the size of articles to be packaged is changed. This exchange is rather troublesome and decreases work efficiencies.

SUMMARY OF THE INVENTION

Accordingly, an object of this invention is to provide a packaging machine in which all of the above-described difficulties accompanying conventional packaging machines are eliminated.

It is another object of this invention to provide a packaging machine in which no shift d is caused during the packaging operation.

A further object of this invention is to provide a packaging machine wherein preparation for different sizes can be readily achieved.

The foregoing objects of the invention have been achieved by the provision of a packaging machine in which a belt-shaped packaging sheet fed continuously by feeding means is cut to a predetermined length by cutting means while being guided and conveyed in a direction intersecting the conveyance direction of articles to be packaged. The packaging sheet is folded in two to package each article as the article is conveyed. The machine comprises according to this invention, a first position detector which detects the arrival of the top end of the packaging sheet, which is guided and conveyed in the direction intersecting the conveyance direction of the articles, at a predetermined feeding limit position. The detector applies a stop signal to the feeding means. A second position detector detects the arrival of each article at a position before the position where the article crosses the packaging sheet, to apply a start signal to the feeding means. A third position detector detects the arrival of the top end of the packaging sheets, returned from the feeding limit position by being moved as the article abuts against the packaging sheet. As the article is further conveyed, at a predetermined reverse return position the third detector applies a start signal to the cutting means.

One example of the packaging machine according to the invention will be described with reference to the accompanying drawing.

DESCRIPTION OF THE PREFERRED EMBODIMENT

Figure 1:
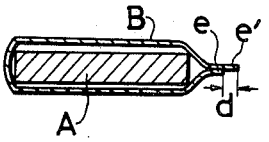
FIG. 1 is a sectional side view of a package formed by a conventional packaging machine.
Figure 2:
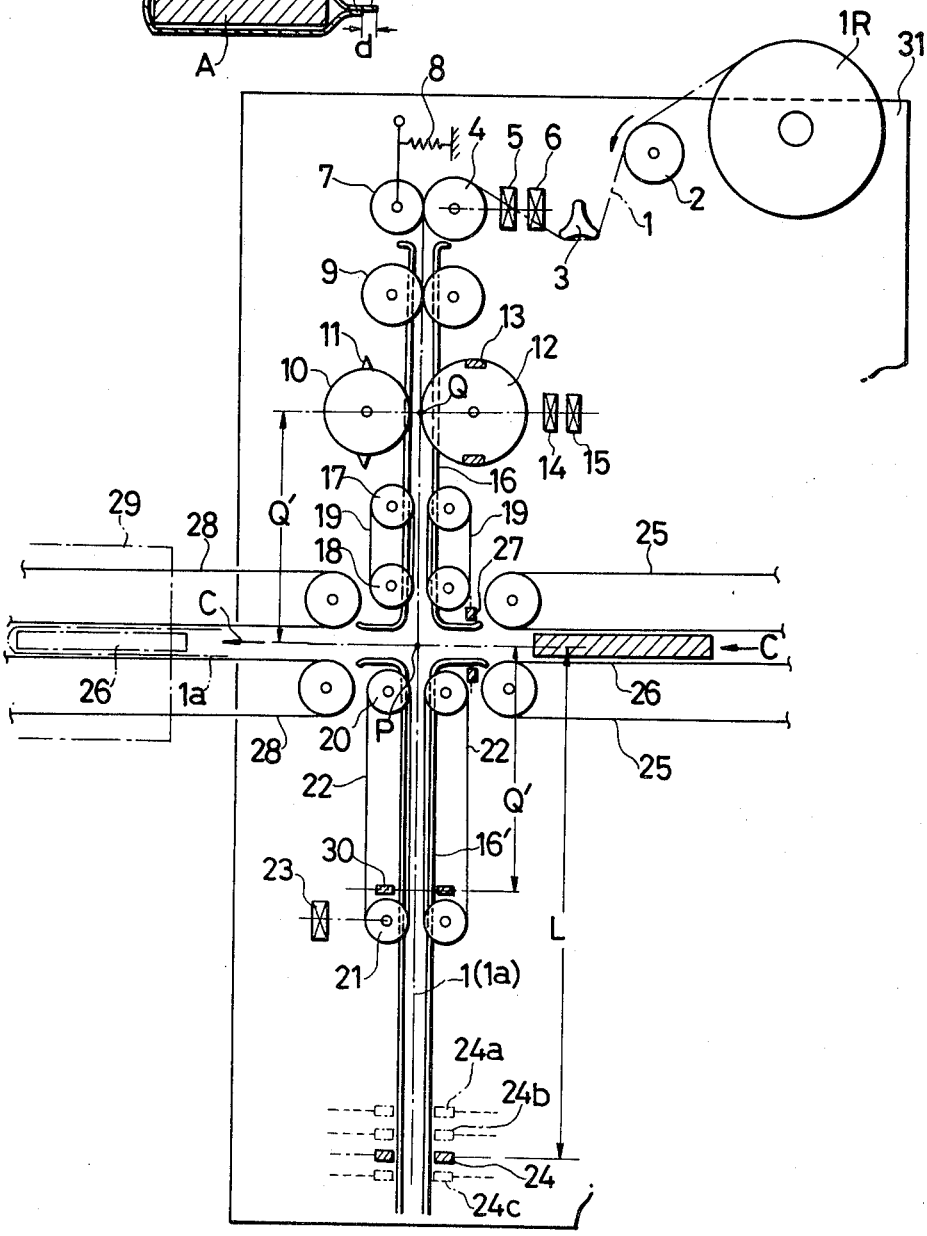
FIG. 2 is a front view of one example of a packaging machine according to this invention.

In FIG. 2, reference numeral 1 designates a packaging sheet and reference character 1R, a packaging sheet roll. The sheet is guided over a pass roll 2 to a decurler 3 for correcting the curl of the packaging sheet 1. A feed roll 4 feeds the packaging sheet 1 from the roll 1R past an electro-magnetic clutch 5 for switching the drive system of the packaging sheet 1 to be described later. An electro-magnetic brake 6 is employed for braking the drive system.

A nip roller 7 is energized toward the feed roll 4 by a spring 8. A pair of corrugating rolls 9 are used for making the packaging sheet 1 rigid and reference numeral 10 designates a cutter drum having cutters 11 on its cylindrical outer surface to cut the packaging sheet 1. A second cutter drum 12 having mating cutters 13 on its cylindrical outer surface, engages with the aforementioned cutters 11. Reference numerals 14 and 15 designate an electro-magnetic clutch for switching the operation of the above-described two cutter drums 10 and an electro-magnetic brake for braking the pair of cutter drums 10 and 12.

Upper and lower guide boards 16 and 16' are used straightly guiding the packaging sheet 1. A pair of conveyer drive rolls 17 and 18 are coupled by a belt 19 or the like, two pairs of conveyer drive rolls being provided for holding and conveying the packaging sheet 1 therebetween. A pair of conveyer drive rolls 20 and 21 coupled by a belt 22 or the like, are on the opposite sides of the packaging sheet. These two sets of conveyer driving rolls are provided for holding and conveying the packaging sheet 1 therebetween similarly as in the above-described pairs of conveyer drive rolls 9. An electro-magnetic clutch 23 switches the operation of the conveyer driving rolls 20 and 21. A first position detector 24 detects the arrival of the top end of the packaging sheet 1 at a predetermined feed limit position, which is guided by the guide boards 16 and 16' to provide a detection signal which is applied to the above-described electro-magnetic clutches 5 and 23.

Referring further to FIG. 2, reference numeral 25 designates a pair of belt conveyers for holding and conveying the article to be packaged in a direction perpendicular to the surface of the packaging sheet 1 fed. A second position detector 27 detects the arrival of the article 26 at a predetermined position before the position where it crosses the packaging sheet 1 to output a detection signal which is applied to the above-described electro-magnetic clutch. A pair of belt conveyers 28 are employed for holding and conveying the article 26 and a packaging sheet 1*a* cut to a predetermined length to a sealing section 29.

As the article 26 is conveyed by the conveyers 28, the end of the packaging sheet 1 is returned by being moved in the opposite direction. The arrival of the end of the packaging sheet 1 at a predetermined reverse return position is detected by a third position detector 30. As a result, the detector 30 produces a detection signal which is applied to the above-described electro-magnetic clutch 14. The above-described various components are supported on a frame 31. Each of the above-described first, second and third position detectors is a photo-electric type in which a light emitting section confronts with a light receiving section.

It is well known in the art that the packaging sheet 1 is fed out of the roll 1R through a tension control menas (not shown), the decurler 3 and the corrugating rolls 9. Therefore, the detail description of this operation will not be described. The feed roll 4, the corrugating rolls 9 and the conveyer driving rolls 17 and 18 are coupled through transmission means such as gears (not shown) to a driving source. When the electro-magnetic clutch 5 is energized, these rolls are operated simultaneously to feed the packaging sheet 1 out of the roll 1R. The conveyer drive rolls 20 and 21 are driven at the same speed as the conveyer drive rolls 17 and 18, and the operation thereof is switched by the electro-magnetic clutch 23.

The cutter drums 10 and 12 are disposed respectively on both sides of the guide board 16. The cutter drums 10 and 12 are driven by a driving source (not shown) simultaneously when the electro-magnetic clutch 14 is energized. Hence, the above-described cutters 11 and 13 cooperate to cut the packaging sheet 1 in the widthwise direction. The cutters 11 are in the form of saw teeth. The mating cutters 13 are made of an elastic material such as rubber or plastic. A plurality of cutters 11 and 13 are provided on the outer walls of the cutter drums 10 and 12, as required (as in the case where the length of the article 26 is short, for instance). The first position detector 24 is utilized for setting one half of the length of the packaging sheet 1*a* required to package the article 26 ( in this case, it is the length L of the lower half of a double-down folding in two) packaging sheet 1*a*. The first position detector 24 is placed at the predetermined distance L, along the lower guide board 16', from the intersection P of the conveyance center line of the article 26 and the conveyance center line of the packaging sheet 1, to determine the above-described packaging sheet 1*a* feeding limit. In the case where there are articles 26 different in configuration or in size, other position detectors 24*a*, 24*b* and so on are provided according to the various sizes of articles as shown in FIG. 2.

The articles 26 are conveyed in a direction perpendicular to the packaging sheet 1*a* (in the direction of the arrow C) at substantially equal intervals while being held between the belt conveyers 25 and 28 which are driven at a speed corresponding to the sealing speed of the sealing section 29. The second position detector 27 is positioned by taking into account both the feeding speed of the packaging sheet 1 which is varied because the operation time of the driving system of the clutch 5 or the feed roll 4 may be delayed together with the conveyance speed of the articles 26 which are conveyed by the belt conveyers 25. The third position detector 30 is placed at the distance from the above-described intersection P, and below the intersection. It is positioned at a point equal to the distance Q' from the cutting point Q of the packaging sheet 1 to the intersection P. The sealing section 29 is a three-side sealing type packaging machine well known in the art in which two longitudinal sides of the cut packaging sheet 1*a* and one level side (or rear side) thereof are sealed by a sealing means such as a heat sealer.

The operation of the machine thus constructed according to the invention will now be described.

Before starting the packaging operation, the operator pulls the packaging sheet 1 out of the roll 1R and loads it successively on the pass roll 2, the decurler 3 and the nip roll 3. Then, when the main switch (not shown) is turned on, the electro-magnetic clutches 5 and 23 are operated to cntinuously feed the packaging sheet 1 out of the roll 1R by means of the feed roll 4. The packaging sheet 1 thus fed is moved downwardly along the upper and lower guide boards 16 and 16'. When the top end of the packaging sheet 1 is moved to the above-described feeding limit position by the belts 19 and 22, the first position detector 24 generates an output detection signal. As a result, the electro-magnetic clutches 5 and 23 are deenergized, and simultaneously the electro-magnetic brake 6 is energized to brake the driving system adapted to feed the packaging sheet 1. In this operation, the packaging sheet 1 in the lower guide board 16 is maintained tensioned by being pulled by the small inertial force which remains in the conveyer drive rolls 20 and 21.

On the other hand, upon turning on the main switch, the belt conveyers 25 and 28 are driven, so that the articles prepared to be packaged in the preceding process are conveyed toward one surface of the packaging sheet 1 while being held between the belt conveyers 25. When the article 26 passes through the second position detector 27, the latter 27 produces the detection signal to release the energization of the aforementioned electro-magnetic brake 6 and simultaneously to operate the electro-magnetic clutch 5 again. As a result, the packaging sheet 1 in the upper guide board 16 is fed downwardly. When this feeding starts, the front end of the article 26 is brought to the position close to the surface of the packaging sheet 1.

As the article 26 is further moved, the part around the intersection P of the packaging sheet 1 is depressed by the front end of the article 26. Accordingly, the packaging sheet 1 is folded in two and is conveyed together with the article 26 by the belt conveyers 28 while being held therebetween. With the article conveyed in this manner, the packaging sheet 1 in the lower guide board 16' is pulled upwardly; that is, the packaging sheet 1 is moved back along the lower guide board 16' while being lightly held between the belts 22.

When the end of the packaging sheet 1 passes through the position detector 30, the latter 30 provides the cutting detection signal. In response to this detection signal, the cutter drums 10 and 12 are rotated so that the cutters 11 and 13 cooperate to cut the packaging sheet 1 in the widthwise direction. Thereafter, when the cutter drums 10 and 12 turn through a predetermined angle, the electro-magnetic clutch 14 is deenergized, and simultaneously the electro-magnetic brake 15 is energized. As a result, the cutter drums are stopped at the predetermined position. The article 26 is wrapped with the cut packaging sheet 1*a* in the manner described above, and is then subjected to sealing in the sealing section 29. The above-described operations are repeatedly carried out to successively seal the articles 26 as they are presented for wrapping.

The case where articles to be packaged are equal in size has been described. However, articles different in kind or articles different in size can be packaged by suitably select the first position detectors 24*a*, 24*b*, etc. which have been set up according to the sizes of articles 26. The selection of the detectors can be achieved by operating a changeover switch arranged in sequence.

As is apparent from the above description, with the machine according to the invention, the rear cutting position of the packaging sheet 1 is correctly detected by the third position detector 30 to cut the packaging sheet 1. Accordingly, when the cut packaging sheet 1*a* having wrapped the article 29 has been conveyed to the sealing section 29, the front edge and the rear edge of the packaging sheet 1*a* are correctly in alignment with each other. Therefore, the article 26 is completely sealed in the sealing section 29, and the appearance of the completed article is remarkably improved. As a consequence the overall quality of the package is considerably improved.

Furthermore, in the case where articles different in size from the previous ones are to be packaged, the preparation of the machine can be achieved merely by changing over the first position detector 24 in to actuate another into action. The operation of the packaging machine according to the invention is therefore much simpler than that of the conventional one. Thus, the work efficiency is also remarkably improved.

The invention has been described with reference to its one embodiment; however, it should be noted that the invention is not limited thereto or thereby. For instance, in the above-described embodiment, the packaging sheet 1 is conveyed vertically; however, it may be conveyed horizontally or obliquely, to obtain the same effect. Furthermore, the first, second and third position detectors are not limited to the photo-electric detectors; that is, they may use a variety of sensor means utilizing air or ultrasonic wave or various techniques well known in the art. In addition, the cutting means of the packaging sheet 1 and the guiding and conveying means may be replaced by various means which are obvious to those skilled in the art.

What is claimed is:

1. A packaging machine in which a belt-shaped packaging sheet is fed continuously by feeding means and cut to a predetermined length by cutting means while being guided and conveyed in a direction intersecting a conveyance direction of articles to be packaged, and said packaging sheet is folded to package each article as said article is conveyed, the improvement comprising:

(a) first position detector means for detecting the arrival of the top end of said packaging sheet, said sheet being guided and conveyed in the direction intersecting the conveyance direction of said articles, at a predetermined feeding limit position, said first position detector means generating a stop signal to said feeding means;

(b) second position detector means for detecting the arrival of each article at a position disposed immediately upstream of intersection position where said article crosses said packaging sheet said second position detector means applying a start signal to said feeding means; and (c) third position detector means for detecting the arrival of the top end of said packaging sheet returned from said feeding limit position by being moved as said article abuts against said packaging sheet and wherein as said top edge of said packaging sheet is further conveyed, to a predetermined reverse return position said third position detector means applies a start signal to said cutting means.

2. The apparatus of claim 1 wherein said feeding means is in a direction perpendicular to the conveyance direction of articles to be packaged.

3. The apparatus of claim 1 wherein said third position detector means is positioned a distance below the point of intersection of said packaging sheet and said articles equal to the distance said cutting means is positioned above said point of intersection.

4. The apparatus of claim 1 or 3 wherein said first position detector means comprises a plurality of position detectors positioned in the direction of guiding said packaging sheet.

5. The apparatus of claim 4 wherein said second position detector is positioned at a point along the direction of conveyance of said articles at a point adjacent the feeding means for said packaging sheet.

6. The apparatus of claim 5 wherein said first, second and third position detector means comprise optical sensors.

7. The apparatus of claims 1 or 2 wherein said feeding means comprises first and second guide boards disposed at positions above and below the position of intersection of said packaging sheet and said articles, and means to hold and advance said packaging sheet on said guide boards.

8. The apparatus of claim 7 wherein said cutting means comprises a pair of cylindrical cutting elements driven in a synchronous manner, said cutting elements being disposed on opposite sides of said packaging sheet.

9. The apparatus of claim 8 further comprising corrugating means disposed upstream of said cutting means for making said packaging strip rigid.

* * * * *